US007008331B2

(12) United States Patent
Chen

(10) Patent No.: US 7,008,331 B2
(45) Date of Patent: Mar. 7, 2006

(54) IRON GOLF CLUB HEAD

(76) Inventor: Archer C. C. Chen, No. 501, 28th Road, Taichung Industrial Park, Taichung (TW)

( * ) Notice: Subject to any disclaimer, the term of this patent is extended or adjusted under 35 U.S.C. 154(b) by 0 days.

(21) Appl. No.: 10/791,705

(22) Filed: Mar. 4, 2004

(65) Prior Publication Data

US 2005/0197206 A1 Sep. 8, 2005

(51) Int. Cl.
*A63B 53/04* (2006.01)

(52) U.S. Cl. ..... 473/342; 473/349; 473/350

(58) Field of Classification Search ..... 473/324, 473/347–350, 329, 330–332, 342
See application file for complete search history.

(56) References Cited

U.S. PATENT DOCUMENTS 4,884,812 A * 12/1989 Nagasaki et al. ..... 473/342
5,080,366 A * 1/1992 Okumoto et al. ..... 473/348
5,447,311 A * 9/1995 Viollaz et al. ..... 473/342
5,779,560 A * 7/1998 Buck et al. ..... 473/342
5,827,131 A * 10/1998 Mahaffey et al. ..... 473/342
5,871,408 A * 2/1999 Chen ..... 473/409
5,967,903 A * 10/1999 Cheng ..... 473/342
6,099,414 A * 8/2000 Kusano et al. ..... 473/342
6,458,045 B1 * 10/2002 Chen ..... 473/342
6,743,117 B1 * 6/2004 Gilbert ..... 473/332
6,918,841 B1 * 7/2005 Chen ..... 473/342
2005/0107183 A1 * 5/2005 Takeda et al. ..... 473/326

* cited by examiner

*Primary Examiner*—Sebastiano Passaniti
(74) *Attorney, Agent, or Firm*—Browdy and Neimark, PLLC

(57) ABSTRACT

An iron golf club head includes a head body, a soft metal layer, a thin face plate and a solder layer. The head body has a recess at a front side thereof and an annular shoulder portion around the recess. The soft metal layer is disposed in the recess of the head body. The thin face plate is disposed at the front side of the head body and attached on the shoulder portion of the head body. The face plate has a plurality of slots on a front side thereof to form a ball-hitting face. The solder layer is provided on a back side of the face plate for bonding the face plate to the shoulder portion of the head body and the soft metal layer.

17 Claims, 2 Drawing Sheets

IRON GOLF CLUB HEAD

BACKGROUND OF THE INVENTION

1. Field of the Invention

The present invention relates generally to a golf club tool, and more particularly to an iron golf club head, which provides a well performance in hitting.

2. Description of the Related Art

A conventional iron golf club head has a head body on which a recess is provided, and a face plate, which has a plurality of slots on its surface, mounted in the recess. Such a golf club head has no space left behind the face plate to enable the face plate to deform when the face plate hits a ball. Therefore, the ball contacts the face plate in a very short time while hitting the ball such that the ball hit by the golf club head is hardly controlled. If a sand wedge has aforesaid head, it would have a poor performance in driving a spin ball while swing in a bunker.

Another type of golf club head is provided with a recess in which fiber reinforced resin is filled, and a face plate having a plurality of slots on its surface is mounted in the recess. The fiber reinforced resin is deformable while the face plate is impacted by a ball, i.e. the face plate is flexible, so as to prolong the contacting time of the ball. Such a golf club head has a small sweet spot because the face plate that is mounted in the recess has a relatively smaller ball-hitting area. In addition, the fiber reinforced resin is exposed around the periphery of the face plate to deface the sense of beauty.

SUMMARY OF THE INVENTION

The primary objective of the present invention is to provide an iron golf club head, which includes a face plate having great flexibility and good support.

According to the objective of the present invention, an iron golf club head comprises a head body, a soft metal layer, a thin face plate and a solder layer. The head body has a recess at a front side thereof and an annular shoulder portion around the recess. The soft metal layer is disposed in the recess of the head body. The thin face plate is disposed at the front side of the head body and attached on the shoulder portion of the head body. The face plate has a plurality of slots on a front side thereof to form a ball-hitting face. The solder layer is provided on a back side of the face plate for bonding the face plate to the shoulder portion of the head body and the soft metal layer.

DETAILED DESCRIPTION OF THE INVENTION

Figure 1:
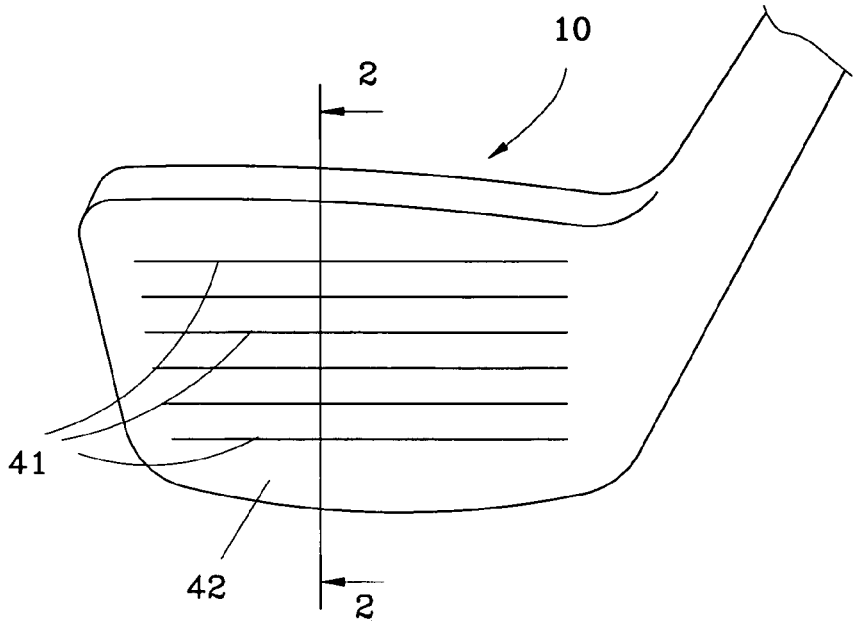
FIG. 1 is a perspective view of a preferred embodiment of the present invention.
Figure 2:
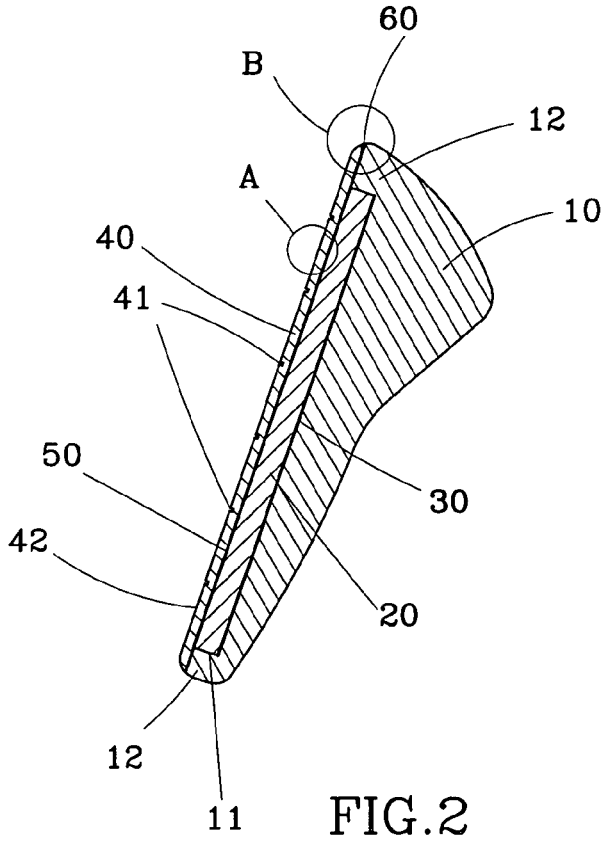
FIG. 2 is a sectional view taken along line 2—2 of FIG. 1.

As shown in FIGS. 1–2, the iron golf club provided by a preferred embodiment of the present invention comprises a head body 10, a soft metal layer 20, a first solder layer 30, a thin face plate 40 and a second solder layer 50.

The head body 10 is made of metal and has a recess 11 at a front side thereof and an annular shoulder portion 12 around the recess 11.

The soft metal layer 20 is disposed in the recess 11 of the head body 10. The soft metal layer 20 has a hardness less than HRC 9 and a thickness ranging from 0.5 mm to 3.0 mm. In practice, the soft metal layer is made of a copper plate mounted in the recess 11.

The first solder layer 30 is provided in the recess 11 between the soft metal layer 20 and a bottom of the recess 11 for firmly mounting the soft metal layer 20 in the recess 11. The first solder layer 30 has a thickness ranging from 0.02 mm to 0.06 mm. Preferably, the thickness of the solder layer 30 is about 0.038 mm. The solder layer 30 is formed by fusing an amorphous metallic plate that is made of a nickel-base brazing solder, such as the nickel-base brazer having a code number of AWS BNI-2 or AMS 4777F.

The thin face plate 40 is disposed on the front side of the head body 10 and attached on the shoulder portion 12. The face plate 40 has a hardness greater than HRC 35 and has a thickness less than 1.5 mm. The face plate 40 has a plurality of slots 41 on its front side so as to form a ball-hitting face 42 of the golf club head. The face plate 40 is made of a durable metallic plate. Preferably, the face plate is made of Maraging Steel.

Figure 3:
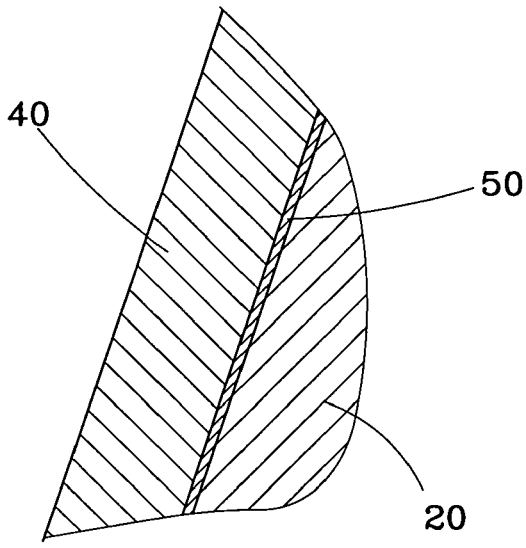
FIG. 3 is an enlarged view of the A section of FIG. 2.

The second solder layer 50, as shown in FIG. 2 and FIG. 3, is provided on a back side of the face plate 40 for bonding the face plate 40 on the shoulder portion 12 of the club body 10 and the soft metal layer 20. The second solder layer 50 has a thickness ranging from 0.02 mm to 0.06 mm. Preferably, the thickness of the second solder layer 50 is 0.038 mm equal to that of the first solder layer 30. The second solder layer 50 is also formed by fusing an amorphous metallic plate that is made of a nickel-base brazing solder, such as the nickel-base brazer having a code number of AWS BNI-2 or AMS 4777F.

Figure 4:
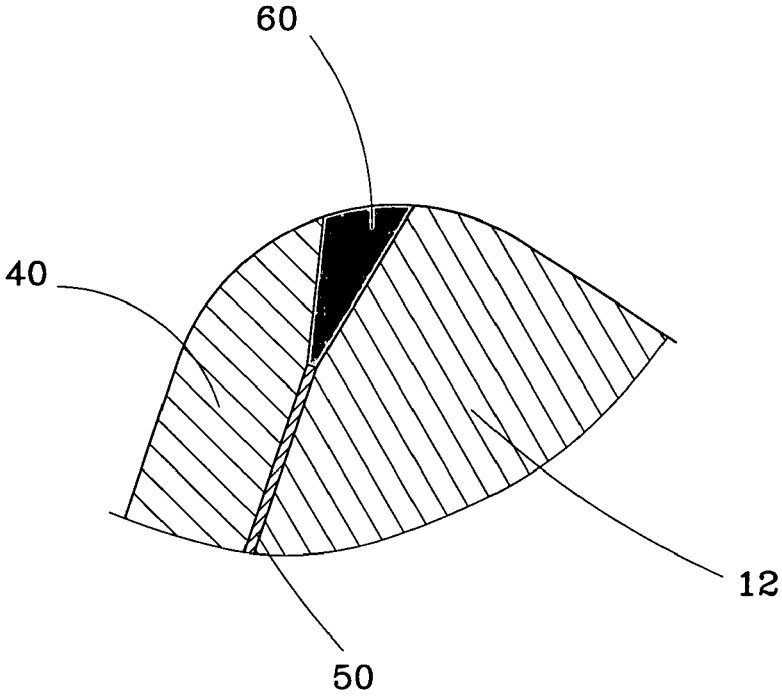
FIG. 4 is an enlarged view of the B section of FIG. 2.

As shown in FIG. 2 and FIG. 4, an annular solder layer 60 is provided at a junction of the face plate 40 and the shoulder portion 12 to enhance the strength of the face plate 40 bonded to the head body 10. In practice, the annular solder layer 60 is provided by a TIG soldering method.

The feature of the present invention is characterized in that a soft metallic layer is provided on a back of a face plate having a higher hardness and durability. The golf club head provided by the present invention has a stronger strength and a well flexibility while the face plate impacts a ball to enhance the performance of hitting ball. The face plate covers on the whole area of the front side of the head body that makes the head of the present invention has a greater area of sweet spot and the golf club head of the present invention has a better perspective view in vision.

It is to be understood that the soft metal layer of the present invention can be firmly mounted in the recess of the head body by other mechanical processes rather than by welding (or brazing) as described above.

What is claimed is:

1. An iron golf club head, comprising:

a head body having a recess at a front side thereof and an annular shoulder portion around the recess;

a soft metal layer disposed in the recess;

a thin face plate fixed on the front side of the head body so as to entirely cover a front edge of the shoulder portion of the head body out to the outer perimeter of the head body, said face plate having a plurality of slots on a front side thereof to form a ball-hitting face; and a solder layer provided on a back side of the face plate for bonding the face plate to the front edge of the shoulder portion of the head body and the soft metal layer.

2. The iron golf club head as defined in claim 1, wherein the soft metal layer is a metal plate mounted in the recess of the head body.

3. The iron golf club head as defined in claim 1, wherein the soft metal layer is made of a copper plate.

4. The iron golf club head as defined in claim 3, wherein the soft metal layer has a hardness less than HRC 9.

5. The iron golf club head as defined in claim 1, wherein the face plate is made of a durable metal plate.

6. The iron golf club head as defined in claim 1, wherein the face plate has a hardness greater than HRC 35.

7. The iron golf club head as defined in claim 1, wherein the face plate is made of maraging steel.

8. The iron golf club head as defined in claim 1, wherein the solder layer is made of a nickel-based brazing solder.

9. The iron golf club head as defined in claim 1, wherein the solder layer has a thickness ranging from 0.02 mm to 0.06 mm.

10. The iron golf club head as defined in claim 1, wherein the solder layer is formed by fusing an amorphous metallic plate.

11. The iron golf club head as defined in claim 1, further comprising a solder layer disposed in between the soft metal layer and a bottom of the recess of the head body for mounting the soft metal layer in the recess of the head body.

12. The iron golf club head as defined in claim 11, wherein the solder layer that is disposed in between the soft metal layer and the bottom of the recess of the head body has a thickness ranging from 0.02 mm to 0.06 mm.

13. The iron golf club head as defined in claim 11, wherein the solder layer that is disposed in between the soft metal layer and the bottom of the recess of the head body is made of a nickel-base brazing solder.

14. The iron golf club head as defined in claim 11, wherein the solder layer that is disposed in between the soft metal layer and the bottom of the recess of the head body is formed by fusing an amorphous metallic plate.

15. The iron golf club head as defined in claim 11, wherein the soft metal layer has a thickness ranging from 0.5 mm to 3.0 mm.

16. The iron golf club head as defined in claim 11, wherein the face plate has a thickness less than 1.5 mm.

17. The iron golf club head as defined in claim 1, further comprising an annular solder layer at a junction of the face plate and the shoulder of the head body.

* * * * *